US008022880B2

(12) United States Patent
Hung et al.

(10) Patent No.: US 8,022,880 B2
(45) Date of Patent: Sep. 20, 2011

(54) CIRCULAR POLARIZED COUPLING DEVICE

(75) Inventors: Kuo-Fong Hung, Taipei (TW); Yi-Cheng Lin, Taipei (TW)

(73) Assignee: National Taiwan University, Taipei (TW)

( * ) Notice: Subject to any disclaimer, the term of this patent is extended or adjusted under 35 U.S.C. 154(b) by 397 days.

(21) Appl. No.: 12/266,506

(22) Filed: Nov. 6, 2008

(65) Prior Publication Data

US 2009/0189717 A1 Jul. 30, 2009

(30) Foreign Application Priority Data

Jan. 28, 2008 (TW) ..... 97103044 A

(51) Int. Cl.
*H01Q 1/38* (2006.01)

(52) U.S. Cl. ..... 343/700 MS; 343/846; 343/779

(58) Field of Classification Search ..... 343/700 MS, 343/788–789, 846, 767, 778–779
See application file for complete search history.

(56) References Cited

U.S. PATENT DOCUMENTS 3,015,101 A * 12/1961 Turner et al. ..... 343/848
5,025,264 A * 6/1991 Stafford ..... 343/767
6,144,344 A * 11/2000 Kim et al. ..... 343/770

* cited by examiner

*Primary Examiner* — Jacob Y Choi
*Assistant Examiner* — Shawn Buchanan

(57) ABSTRACT

A coupling device for transmitting a wireless signal is provided. The coupling device includes a substrate, a ground layer and a feed conductor. The substrate includes a first surface and a second surface opposite to the first surface. The ground layer is disposed on the second surface having a circular opening, and the circular opening has an opening edge and an opening center. The feed conductor extends on the first surface, including a conductive portion and a feed portion connected thereto. The feed portion corresponds to the circular opening, wherein the opening center is on a base line, a radial line is formed between the opening center and the opening edge, a radial distance is formed on the radial line between the opening edge and the feed portion, and a length of the radial distance varies with an angle between the radial line and the base line.

14 Claims, 5 Drawing Sheets

CIRCULAR POLARIZED COUPLING DEVICE

CROSS REFERENCE TO RELATED APPLICATIONS

This Application claims priority of Taiwan Patent Application No. 97103044, filed on Jan. 28, 2008, the entirety of which is incorporated by reference herein.

BACKGROUND OF THE INVENTION

1. Field of the Invention

The invention relates to a coupling device, and more particularly to a coupling device transmitting a circular polarized wireless signal.

2. Description of the Related Art

FIGS. 1*a* and 1*b* show a conventional coupling device 1 for transmitting a circular polarized wireless signal, which comprises a substrate 10, a radiator 20 and a ground layer 30. The substrate 10 comprises a first surface and a second surface. The first surface is opposite to the second surface. The radiator 20 is disposed on the first surface. The ground layer 30 is disposed on the second surface. The radiator 20 is rectangular, and comprises a lead angle 21. FIG. 1*b* is a sectional view along direction A-A of FIG. 1, wherein a coaxial cable 40 is electrically connected to the coupling device 1, and a signal line 41 passes the substrate 10 to be connected to the radiator 20.

Conventional coupling device 1 provides an axial ratio bandwidth of about 3~5%, which, however, cannot transmit wireless signals having various resonance directions.

BRIEF SUMMARY OF THE INVENTION

A detailed description is given in the following embodiments with reference to the accompanying drawings.

A coupling device for transmitting a wireless signal is provided. The coupling device comprises a substrate, a ground layer and a feed conductor. The substrate comprises a first surface and a second surface, wherein the first surface is opposite to the second surface. The ground layer is disposed on the second surface, wherein the ground layer has a circular opening, and the circular opening has an opening edge and an opening center. The feed conductor extends on the first surface and comprises a conductive portion and a feed portion, wherein the conductive portion is connected to the feed portion and the feed portion corresponds to the circular opening. The opening center is on a base line, the conductive portion extends parallel to the base line, a radial line is formed between the opening center and the opening edge, a radial distance is formed on the radial line between the opening edge and the feed portion, and a length of the radial distance varies with an angle between the radial line and the base line.

The invention provides an axial ratio bandwidth of about 15%. Thus, comparing with conventional art, the invention can transmit wireless signals having various resonance directions. Additionally, the transmission band (return loss lower than −10 dB) is about 9~11 GHz. Therefore, the coupling device of the invention provides increased bandwidth.

BRIEF DESCRIPTION OF THE DRAWINGS

The invention can be more fully understood by reading the subsequent detailed description and examples with references made to the accompanying drawings, wherein.

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims.

Figure 1A:
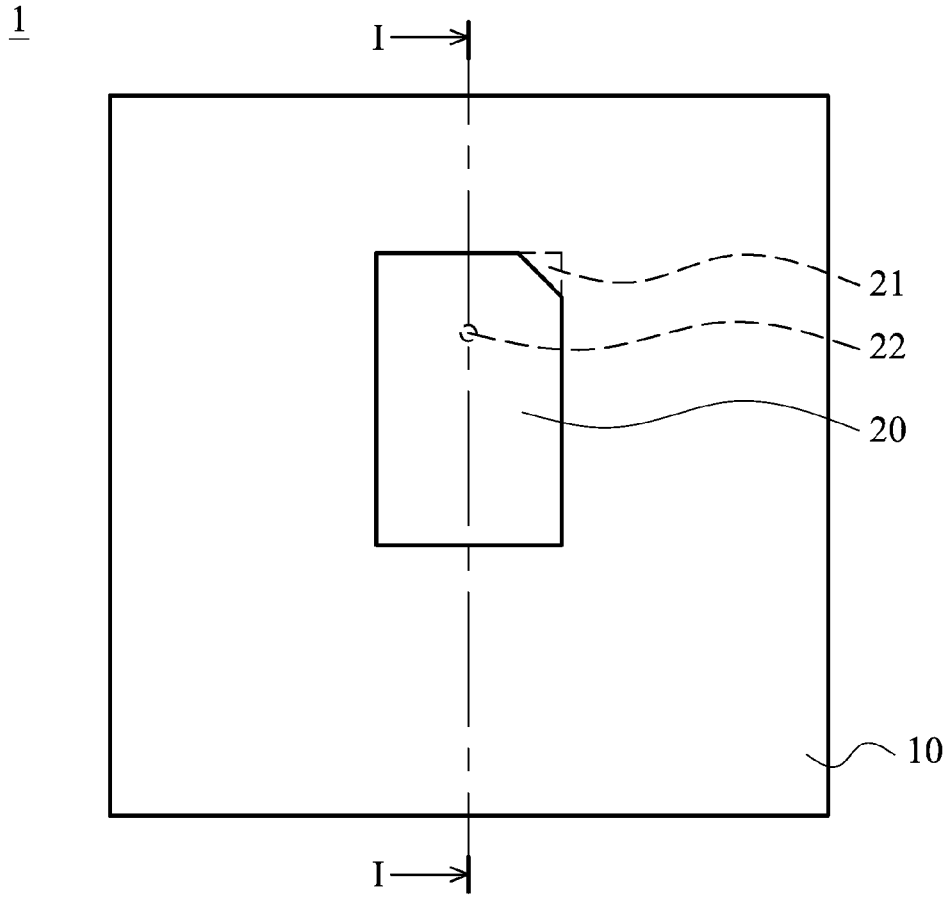
FIG. 1a (PRIOR ART)
FIG. 1*a* shows a conventional coupling device.
Figure 1B:
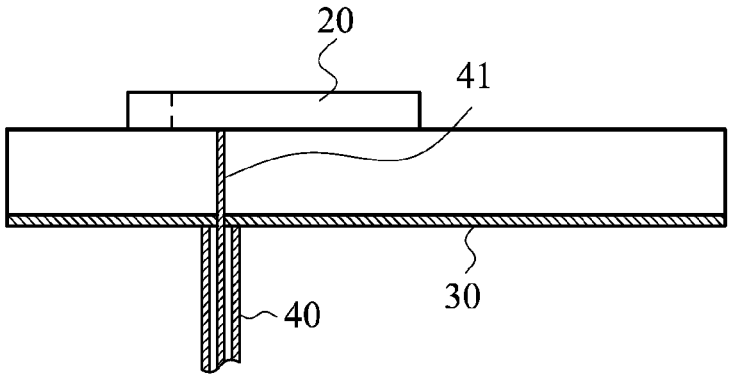
FIG. 1b (PRIOR ART)
FIG. 1*b* is a sectional view along direction A-A of FIG. 1.
Figure 2A:
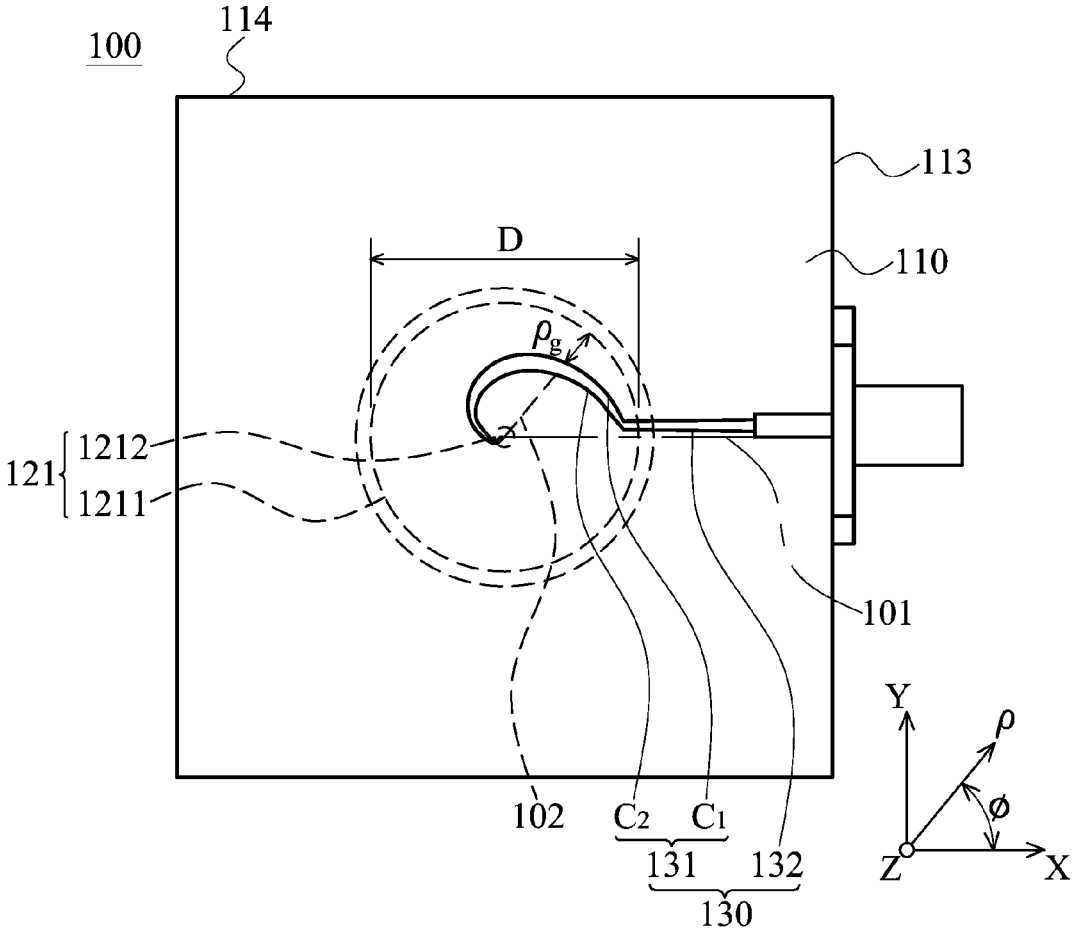
FIG. 2*a* is a top view of a coupling device of an embodiment of the invention.
Figure 2B:
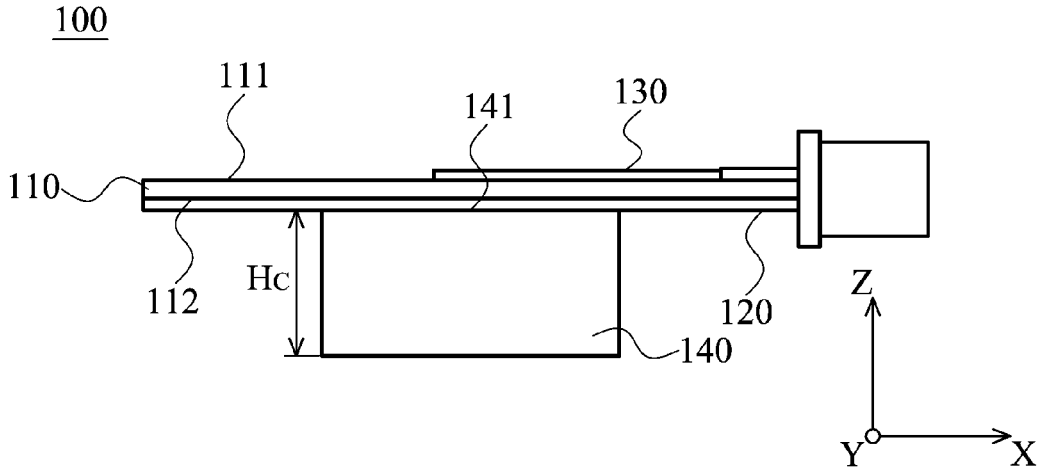
FIG. 2*b* is a side view of the coupling device of the embodiment of the invention.

FIG. 2*a* is a top view of a coupling device 100 of an embodiment of the invention, and FIG. 2*b* is a side view of the coupling device 100 of the embodiment of the invention. With reference to FIGS. 2*a* and 2*b*, the coupling device 100 comprises a substrate 110, a ground layer 120, a feed conductor 130 and a chamber 140. The substrate 110 comprises a first surface 111 and a second surface 112. The first surface 111 is opposite to the second surface 112. The ground layer 120 is disposed on the second surface 112. The ground layer 120 comprises a circular opening 121. The circular opening 121 comprises an opening edge 1211 and an opening center 1212. The feed conductor 130 extends on the first surface 111. The feed conductor 130 comprises a conductive portion 132 and a feed portion 131. The conductive portion 132 is connected to the feed portion 131. The feed portion 131 corresponds to the circular opening 121. The opening center 1212 is on a base line 101. A radial line 102 is formed between the opening center 1212 and the opening edge 1211. A radial distance $\rho_g$ is formed on the radial line 102 between the opening edge 1211 and the feed portion 131, and a length of the radial distance $\rho_g$ varies with an angle $\phi$ between the radial line 102 and the base line 101.

The substrate 110 further comprises a first edge 113 and a second edge 114. The first edge 113 is perpendicular to the second edge 114. The conductive portion 132 extends from the first edge 113 toward the circular opening 121. The base line 101 is parallel to the second edge 114, and the conductive portion 132 extends parallel thereto.

The coupling device 100 transmits a circular polarized wireless signal.

When the angle $\phi$ between the radial line 102 and the base line 101 varies in a counterclockwise direction, the radial distance $\rho_g$ increases.

The feed portion 131 comprises a first edge curve $C_1$ and a second edge curve $C_2$, and the first edge curve $C_1$ and the second edge curve $C_2$ satisfy the following functions:

$$C_1:\ \rho = \frac{D}{2}e^{-\alpha\phi}, \tag{1}$$

$$C_2:\ \rho = \left(\frac{D}{2} - t\right)e^{-\beta\phi}, \tag{2}$$

wherein D is a diameter of the circular opening, $\alpha$ is a spiral rate coefficient of the first edge curve $C_1$, $\beta$ is a spiral rate coefficient of the second edge curve $C_2$, and t is an initial thickness of the feed portion.

The first edge curve $C_1$ and the second edge curve $C_2$ comprise an end angle $\phi_e$, and the end angle $\phi_e$ is smaller than $2\pi$.

Figure 3:
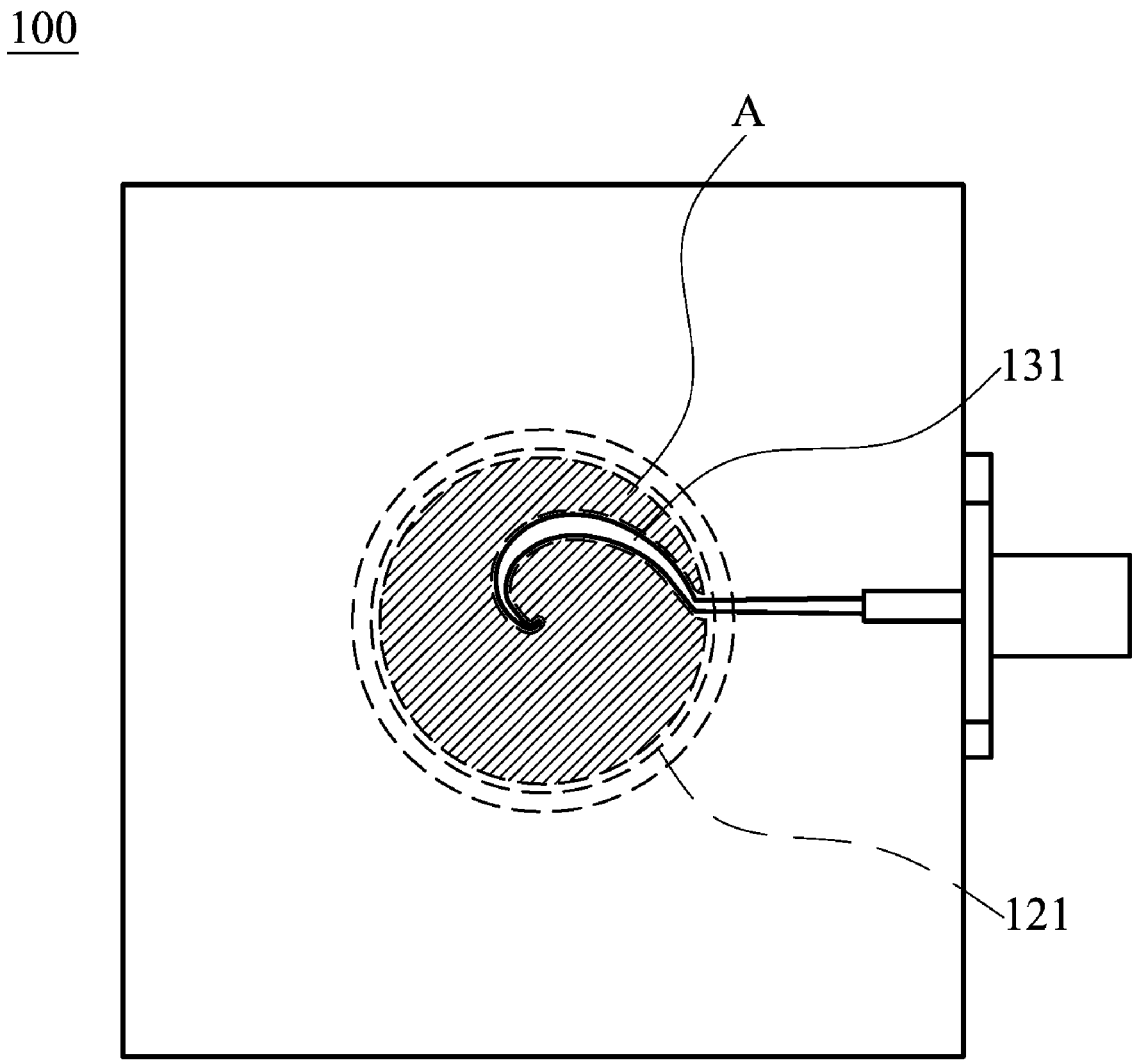
FIG. 3 shows a resonance area of the coupling device of the embodiment of the invention.

With reference to FIG. 3, in the embodiment of the invention, the radial distance $\rho_g$ varies with the angle $\phi$ between the radial line 102 and the base line 101. Thus, a special shaped resonance area A is defined in the circular opening 121. When the coupling device transmits a circular polarized wireless signal, the feed portion 131 couples the circular opening 121 to transmit the circular polarized wireless signal via the resonance area A.

In the embodiment of the invention, the thickness t equals 0.5 mm, the diameter of the circular opening D equals 20 mm, the spiral rate coefficient of the first edge curve $\alpha$ equals 0.5, the spiral rate coefficient of the first edge curve $\beta$ equals 0.7, and the end angle $\phi_e$ equals $1.5\pi$.

In the embodiment mentioned above, the first edge curve $C_1$ and the second edge curve $C_2$ satisfies functions (1) and (2). However, the invention is not limited by functions (1) and (2). In the invention, the coupling device has the possibility to transmit the circular polarized wireless signal when the radial distance $\rho_g$ varies with the angle $\phi$ between the radial line 102 and the base line 101 (for example, the radial distance $\rho_g$ increases when the angle $\phi$ between the radial line 102 and the base line 101 varies in a counterclockwise direction).

With reference to FIGS. 2*a* and 2*b*, the chamber 140 comprises a chamber opening 141. The chamber opening 141 corresponds to the circular opening 121. Therefore, the chamber 140 shields the circular opening 121 to enhance signal strength and improve transmission effect. The chamber 140 is electrically connected to the ground layer 120, which is a cylindrical structure made of metal. The chamber 140 comprises a chamber height $H_c$, and the chamber height $H_c$ nears a quarter of a wavelength of the wireless signal. In a modified embodiment, the chamber height $H_c$ can be smaller than a quarter of a wavelength of the wireless signal, which can also satisfy particular transmission requirement.

In the embodiment, the chamber 140 enhances signal strength to improve transmission effect. However, the invention is not limited thereby. In a modified embodiment, the chamber 140 can be omitted, and the coupling device can transmit the wireless signal by only the substrate 110, the ground layer 120 and the feed conductor 130.

Figure 4:
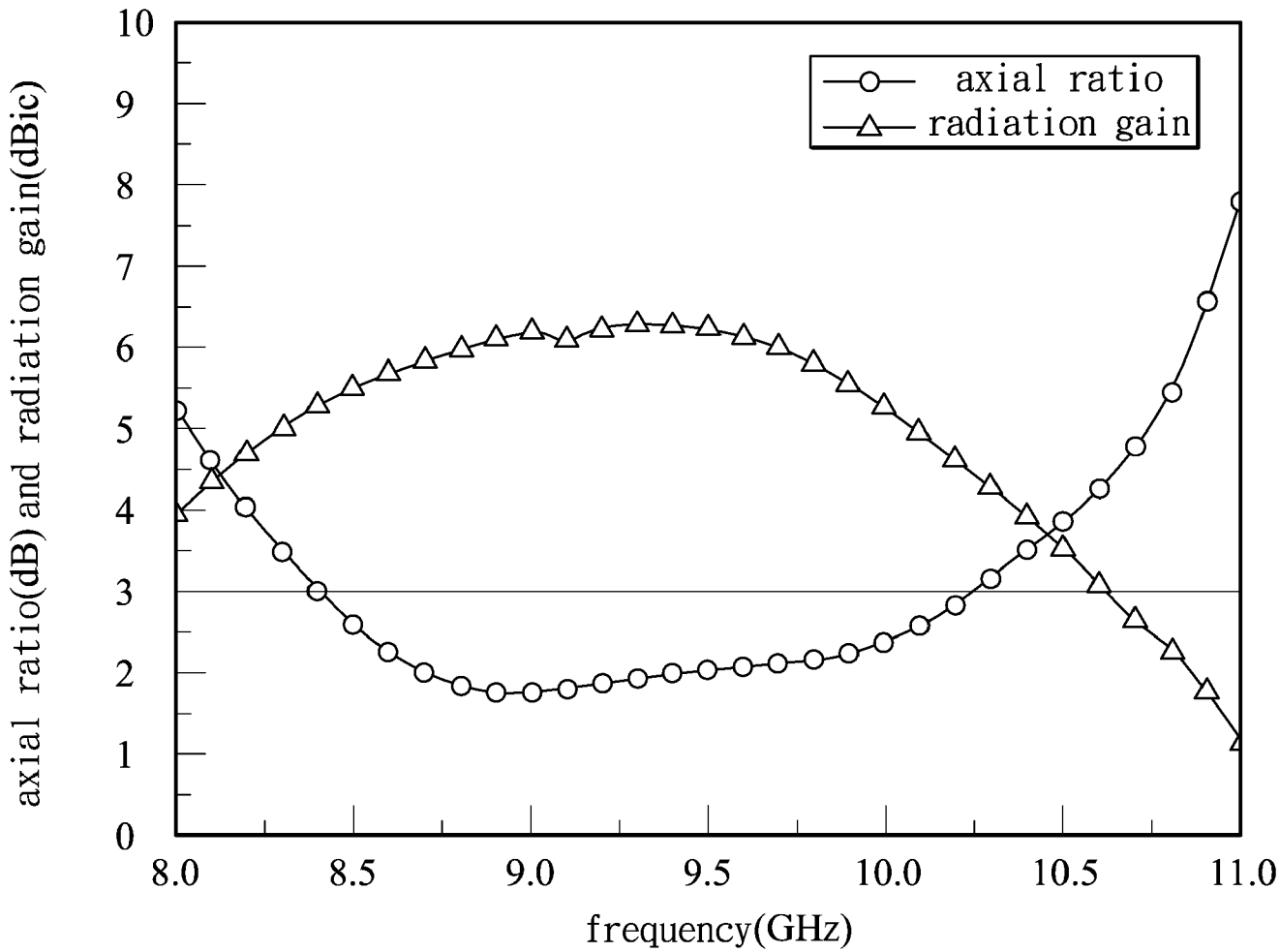
FIG. 4 shows frequency response of radiation gain and axial ratio observed at the zenith of the coupling device of the embodiment of the invention.

FIG. 4 shows frequency response of radiation gain and axial ratio observed at the zenith of the coupling device of the embodiment of the invention. As shown in FIG. 4, the invention provides an axial ratio bandwidth of about 15%. Thus, comparing with conventional art, the invention can transmit wireless signals having various resonance directions.

Figure 5:
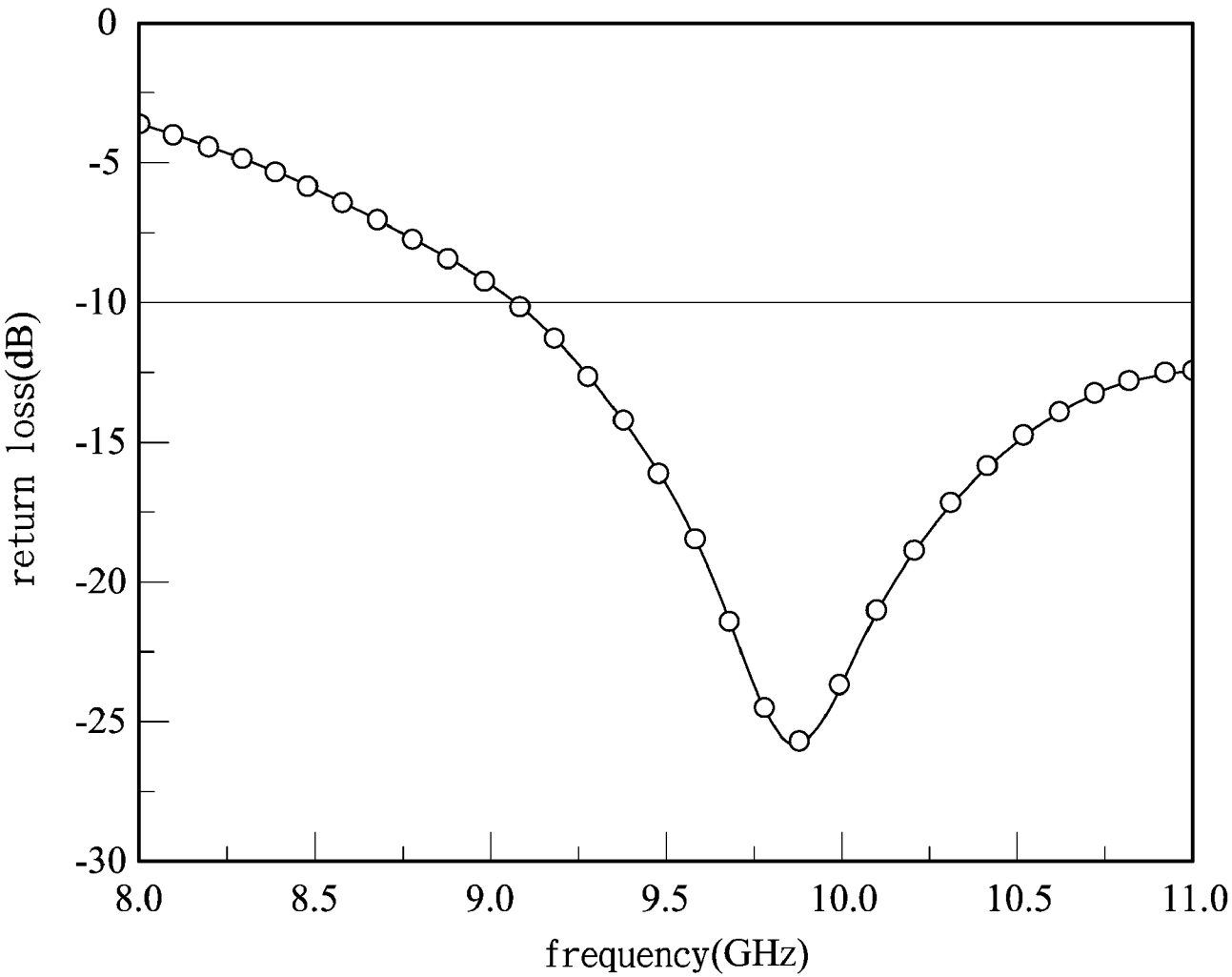
FIG. 5 shows return loss of the coupling device of the embodiment of the invention.

FIG. 5 shows return loss of the coupling device of the embodiment of the invention. With reference to FIG. 5, the transmission band (return loss lower than −10 dB) is about 9~11 GHz. Therefore, the coupling device of the invention provides increased bandwidth.

The coupling device of the invention can be utilized in a feed structure of a circular polarized antenna or a transducer of a wave guide.

While the invention has been described by way of example and in terms of preferred embodiment, it is to be understood that the invention is not limited thereto. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A coupling device for transmitting a circular polarized wireless signal, comprising: a substrate, comprising a first surface and a second surface, wherein the first surface is opposite to the second surface; a ground layer, disposed on the second surface, wherein the ground layer has a circular opening, and the circular opening has an opening edge and an opening center; and a feed conductor, extending on the first surface, wherein the feed conductor comprises a conductive portion and a feed portion, the conductive portion is connected to the feed portion, and the feed portion corresponds to the circular opening, and the opening center is on a base line, the conductive portion extends parallel to the base line, a radial line is formed between the opening center and the opening edge, a radial distance is formed on the radial line between the opening edge and the feed portion, and a length of the radial distance varies with an angle between the radial line and the base line, wherein when the angle between the radial line and the base line varies in a counterclockwise direction, the radial distance increases; and wherein the feed portion comprises a first edge curve $C_1$ and a second edge curve $C_2$, and the first edge curve $C_1$ and the second edge curve $C_2$ satisfy the following functions:

$$C_1:\ \rho = \frac{D}{2}e^{-\alpha\phi}, \tag{1}$$

$$C_2:\ \rho = \left(\frac{D}{2} - t\right)e^{-\beta\phi}, \tag{2}$$

wherein D is a diameter of the circular opening, $\alpha$ is a spiral rate coefficient of the first edge curve $C_1$, $\beta$ is a spiral rate coefficient of the second edge curve $C_2$, and t is an initial thickness of the feed portion.

2. The coupling device as claimed in claim 1, wherein the first edge curve $C_1$ and the second edge curve $C_2$ comprise an end angle $\phi_e$, and the end angle $\phi_e$, is smaller than $2\pi$.

3. The coupling device as claimed in claim 1, further comprising a chamber disposed on the ground layer, wherein the chamber comprises a chamber opening, the chamber opening corresponds to the circular opening, and the chamber shields the circular opening.

4. The coupling device as claimed in claim 3, wherein the chamber comprises a chamber height $H_c$, and the chamber height $H_c$, nears a quarter of a wavelength of the circular polarized wireless signal.

5. The coupling device as claimed in claim 3, wherein the chamber is cylindrical.

6. The coupling device as claimed in claim 3, wherein the chamber is made of metal.

7. The coupling device as claimed in claim 3, wherein the chamber is electrically connected to the ground layer.

8. A coupling device for transmitting a circular polarized wireless signal, comprising: a substrate, comprising a first edge, a second edge, a first surface and a second surface, wherein the first surface is opposite to the second surface, and the first edge is perpendicular to the second edge; a ground layer, disposed on the second surface, wherein the ground layer has a circular opening, and the circular opening has an opening edge and an opening center; and a feed conductor, extending on the first surface, wherein the feed conductor comprises a conductive portion and a feed portion, the conductive portion is connected to the feed portion, the feed portion corresponds to the circular opening, and the conductive portion extends from the first edge toward the circular opening, and the opening center is on a base line, the base line is parallel to the second edge, a radial line is formed between the opening center and the opening edge, a radial distance is formed on the radial line between the opening edge and the feed portion, and a length of the radial distance varies with an angle between the radial line and the base line, wherein when the angle between the radial line and the base line varies in a counterclockwise direction, the radial distance increases; wherein the feed portion comprises a first edge curve $C_1$ and a second edge curve $C_2$, and the first edge curve $C_1$ and the second edge curve $C_2$ satisfy the following functions:

$$C_1:\ \rho = \frac{D}{2}e^{-\alpha\phi}, \tag{1}$$

$$C_2:\ \rho = \left(\frac{D}{2} - t\right)e^{-\beta\phi}, \tag{2}$$

wherein D is a diameter of the circular opening, $\alpha$ is a spiral rate coefficient of the first edge curve $C_1$, $\beta$ is a spiral rate coefficient of the second edge curve $C_2$, and t is an initial thickness of the feed portion.

9. The coupling device as claimed in claim 8, wherein the first edge curve $C_1$ and the second edge curve $C_2$ comprise an end angle $\phi_e$, and the end angle $\phi_e$, is smaller than $2\pi$.

10. The coupling device as claimed in claim 8, further comprising a chamber disposed on the ground layer, wherein the chamber comprises a chamber opening, the chamber opening corresponds to the circular opening, and the chamber shields the circular opening.

11. The coupling device as claimed in claim 10, wherein the chamber comprises a chamber height $H_c$, and the chamber height $H_c$, nears a quarter of a wavelength of the circular polarized wireless signal.

12. The coupling device as claimed in claim 10, wherein the chamber is cylindrical.

13. The coupling device as claimed in claim 10, wherein the chamber is made of metal.

14. The coupling device as claimed in claim 10, wherein the chamber is electrically connected to the ground layer.

* * * * *